US005147280A

United States Patent [19]

Carlsson et al.

[11] Patent Number: 5,147,280

[45] Date of Patent: Sep. 15, 1992

[54] ENERGY TRANSFORMATION DEVICE

[75] Inventors: Claes-Göran Carlsson, Tumba; Claes Inge, Saltsjö-Duvnäs; Peter Franzén, Tullinge; Torgny Lagerstedt, Stockholm; Leonard Borgström, Bandhagen; Hans Moberg, Stockholm; Olle NÅbo, Tullinge, all of Sweden

[73] Assignee: Alfa-Lavel Separation AB, Tumba, Sweden

[21] Appl. No.: 602,247

[22] PCT Filed: Mar. 30, 1990

[86] PCT No.: PCT/SE90/00208

§ 371 Date: Nov. 8, 1990

§ 102(e) Date: Nov. 8, 1990

[87] PCT Pub. No.: WO90/11835

PCT Pub. Date: Oct. 18, 1990

[30] Foreign Application Priority Data

Apr. 7, 1989 [SE] Sweden ..... 8901254

[51] Int. Cl.[5] ..... B04B 7/00; B04B 11/00

[52] U.S. Cl. ..... 494/56; 494/43

[58] Field of Search ..... 494/27, 56, 58, 60, 494/37, 43; 210/781, 782; 415/89, 71, 90, 120

[56] References Cited

U.S. PATENT DOCUMENTS 3,228,595 1/1966 Sharples ..... 494/37
3,747,843 7/1973 Joyce ..... 494/67
4,330,080 5/1982 Mathieu ..... 494/43
4,406,652 9/1983 Nielsen ..... 494/56

FOREIGN PATENT DOCUMENTS 0714215 11/1941 Fed. Rep. of Germany ..... 494/23

*Primary Examiner*—Philip R. Coe
*Assistant Examiner*—Tony Soohoo
*Attorney, Agent, or Firm*—Seidel, Gonda, Lavorgna & Monaco

[57] ABSTRACT

A centrifugal separator having a device for the transformation of kinetic energy of a liquid rotating in a chamber (12) to pressure energy comprising a discharge element (17) for the discharge of liquid out of the chamber. The discharge element (17) has a surface (20) arranged to be so located in the rotating liquid body that liquid flows in a predetermined direction along and in contact with the surface (20). The discharge element (17) forms an outlet channel (19) having an inlet opening (22) located in said surface (20), and limited downstreams by a cross edge (25) from which the outlet channel (19) extends a bit essentially in said predetermined direction. An increased outlet pressure is achieved by the fact that at least two passages (27, 28) are arranged in the discharge element (17) connecting a part each of the outlet channel located at axial ends of the cross edge (25), respectively, to the chamber (12) in such a manner that liquid flows through the passages (27, 28).

18 Claims, 3 Drawing Sheets

ENERGY TRANSFORMATION DEVICE

Figure 1:
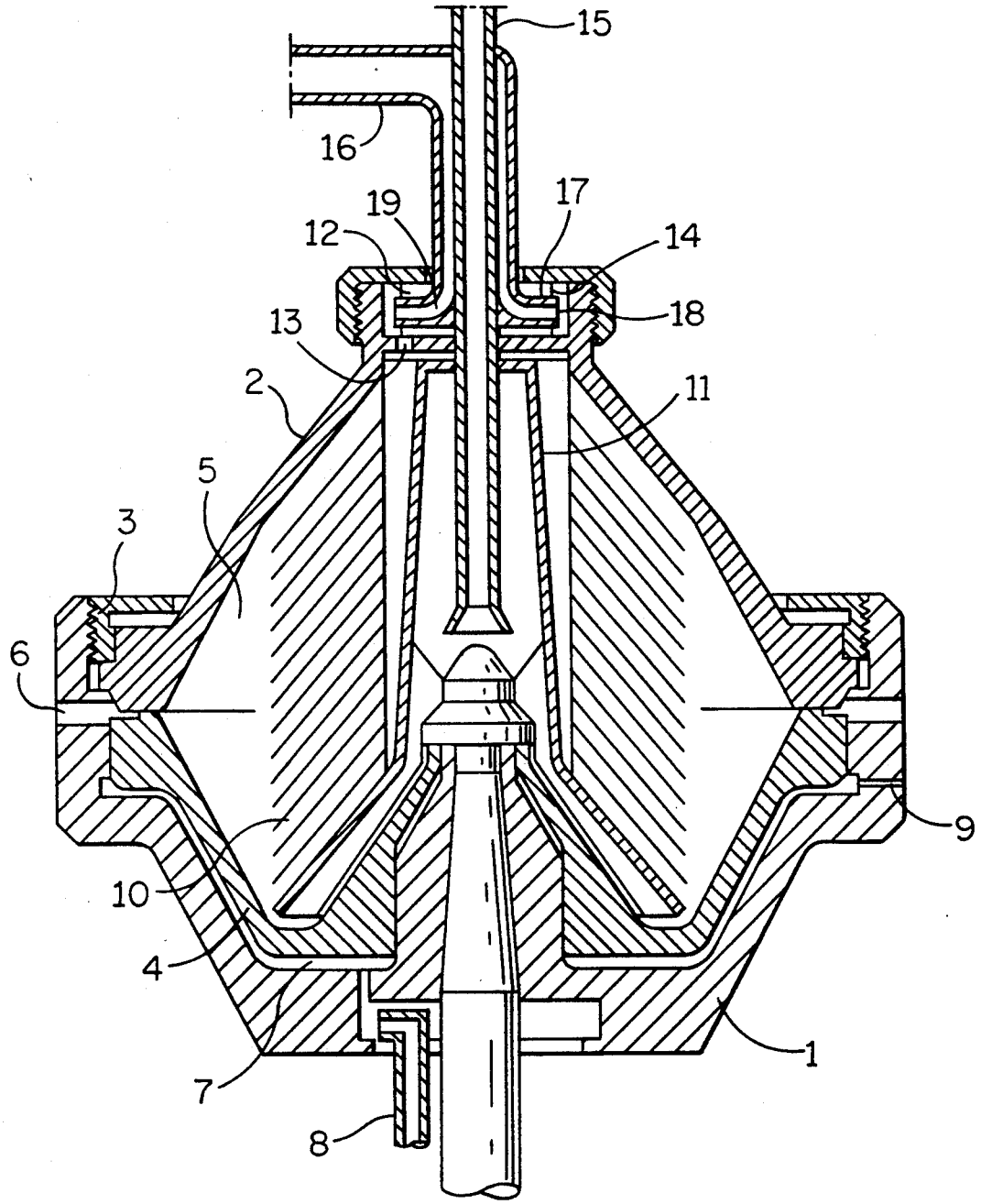

The present invention concerns a centrifugal separator having a device for the transformation of kinetic energy of a liquid rotating in a chamber around a rotational axis to pressure energy. More precisely determined the device comprises a preferably stationary discharge element for the discharge of liquid out of the chamber, which discharge element has a surface surrounding the rotational axis arranged to be so located in the rotating liquid body that liquid flows in a predetermined direction along and in contact with the surface. The discharge element forms an outlet channel having an inlet opening located in said surface, which in the downstream direction of the liquid flow is delimited by a cross edge extending perpendicular to the flow direction. The outlet channel extends for a distance essentially in said downstream direction from the cross edge.

In a centrifugal separator, which is provided with an energy transformation device of said kind, parts of the rotor of the centrifugal separator form an outlet chamber in which liquid rotates. The outlet chamber is arranged to receive a separated liquid continuously from the separation chamber of the centrifugal rotor. This liquid forms a rotating liquid body in the outlet chamber. Centrally in the outlet chamber there is arranged a discharge element through which liquid is discharged out of the outlet chamber and further out of the centrifugal rotor. A centrifugal separator of this kind is shown in WO 88/7893 for instance.

In many cases it is important that the energy transformation device can transform as much as possible of the energy stored in the rotating liquid to pressure energy. How high of a pressure you then can achieve as a maximum is determined by the equation of Bernoullis for the pressure along a flow line of the liquid.

$$P_{stat}+P_{dyn}=konst$$

The static pressure $P_{stat}$ at the inlet opening is composed by the pressure from the part of the rotating liquid body, which is located radially inside the inlet opening, and the pressure which acts on this part of the liquid body.

The dynamic pressure $P_{dyn}$ is in each point along a flow line determined by the equation $$P_{dyn}=\tfrac{1}{2}\rho W^2$$

in which $\rho$ is the density of the liquid and W is the flow rate of the liquid in the point looked upon.

Outside the inlet opening the liquid has a total pressure, which is the sum of the static and dynamic pressure there. However, in the device in a centrifugal separator known by WO 88/7893 only a minor part of the dynamic pressure can be recovered in the form of a liquid pressure in the outlet. Therefore, another device has been suggested for separators for the recovery of the kinetic energy of the rotating liquid, which is to be discharged out of the chamber of the centrifugal rotor. This device comprises a discharge device, which has a radial extension and an inlet opening in its radial outer portion facing the flow direction of the liquid. By facing the inlet opening in this way a greater part of the dynamic pressure of the rotating liquid outside the discharge device can be recovered in the form of a liquid pressure. However, a discharge device designed in this manner has a great slowing down effect on the liquid in the chamber. Furthermore, it has a heavy agitating effect on the liquid, which results in partly a great risk for the admixture of air in the discharged liquid, partly a possibly damaging mechanical influence of the liquid.

The object of the present invention is to accomplish a centrifugal separator having a device of the kind initially described for the transformation of kinetic energy of a rotating liquid to pressure energy, which device is able to recover a greater part of the static and the dynamic pressure in the rotating liquid than previously known such devices without involving an increasing risk for the admixture of air in the liquid. The object is furthermore that the device shall be able to do this without resulting in a too greater retarding effect and too heavy stresses on the liquid, and without increasing the risk for oscillating movements of the rotating system.

This is achieved according to the present invention by providing a centrifugal separator with a device of the said kind which has at lest two passages arranged in the outlet device connecting a part of the outlet channel each located at axial ends of the cross edge respectively to the chamber in a way such that liquid flows through the passages.

By designing the device in this manner a far greater pressure can be achieved in the outlet of the discharge element than by hitherto known devices. Hereby, a pump arranged in the outlet conduit can possibly be avoided, or the radial dimensions of the outlet element can be reduced, whereby wanted liquid pressure in the outlet can be achieved with less energy losses. This is possible without creating great stresses on the separated liquid and without resulting in an increased risk of admixture of air or unstable operation conditions.

The improved recovery of the dynamic pressure in the rotating liquid can be explained by the fact that the passages result in a greater part of the liquid flowing along the surface of the discharge element is conducted into outlet channel and towards the cross edge. A part of the liquid flowing through the inlet opening is conducted passing the cross edge and further through the outlet channel towards an outlet, an other part flows out again out of the outlet channel through the inlet opening.

Along many of the flow lines, which during operation thus extend into the inlet opening, the flow rate decreases considerably nearby the cross edge, whereby a great part of the dynamic pressure in the rotating liquid is transformed into static pressure, which becomes effective in the outlet channel and in an outlet connected thereto.

In order to give the best possible effect the passage preferably is not arranged in the cross edge itself but extends from a part of the outlet element, which together with the cross edge surrounds the outlet channel. Suitably the device comprises an even number of passages which are located symmetrically relative to a middle line through the inlet opening extending in the predetermined direction.

In a preferred embodiment the passages extend essentially in the predetermined direction. The greatest outlet pressure is then achieved if the passages extend from the cross edge seen in the predetermined direction.

In another preferred embodiment the inlet opening seen in the predetermined direction is limited by two side edges, each one of which extends towards and is turned into a limiting surface of one of the said passages.

To provide further advantages the side edges can diverge seen in the predetermined direction, having such a direction relative to the flow direction of the rotating liquid body that liquid crossing a side edge flows towards the inlet opening.

At least one of said side edges can include a curved shape, the radius of the curvature of the side edge preferably varies along the side edges in a way such that in the flow direction from being convex towards the inlet opening it turns to be concave towards the same.

Figure 2:
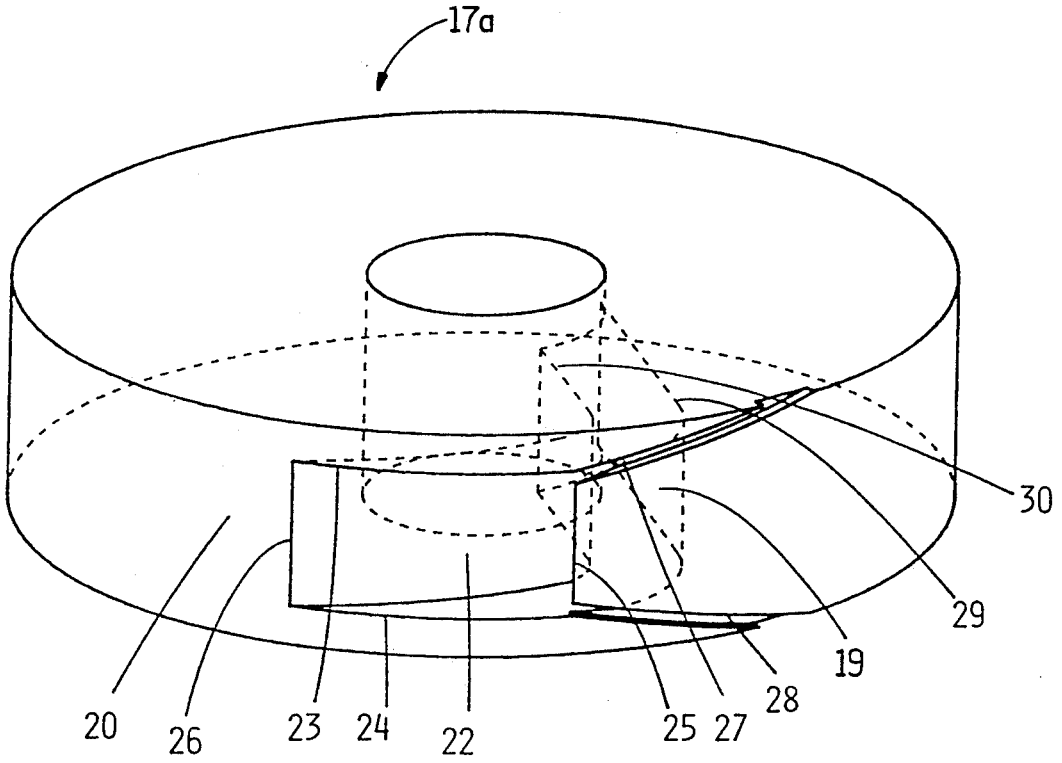
Figure 3:
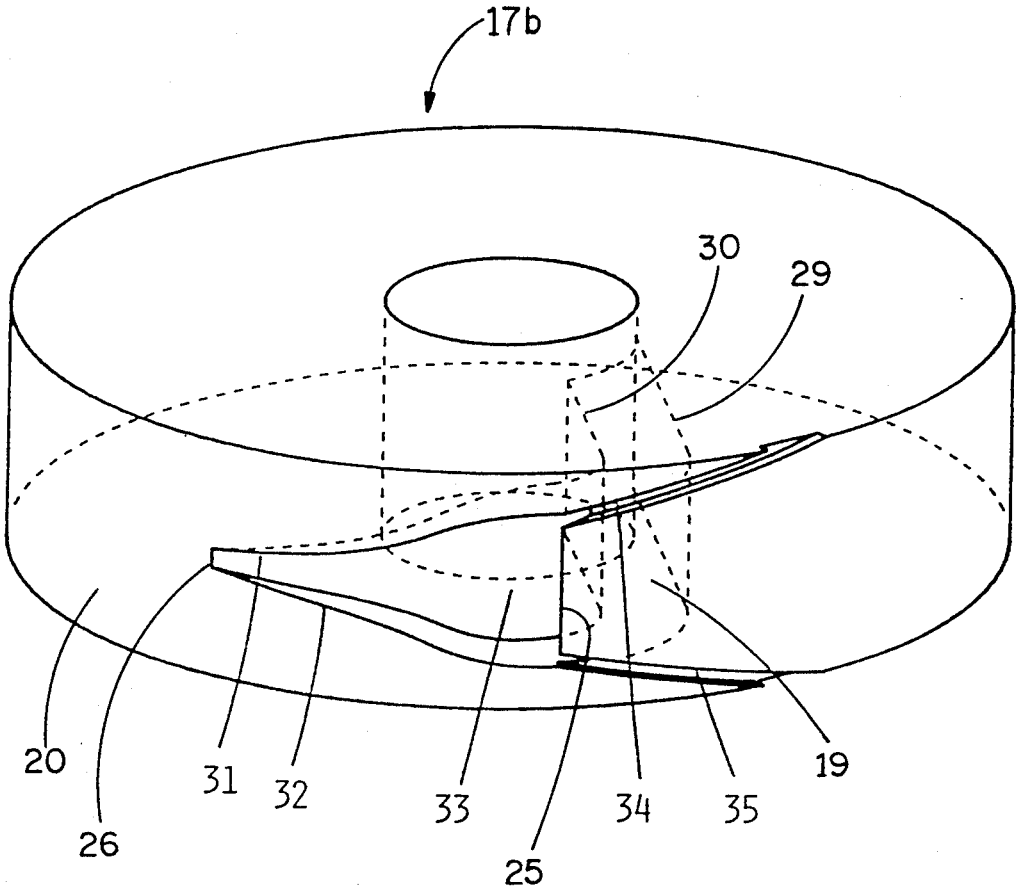

In the following the invention will be described more closely with reference to the accompanying drawings, in which FIG. 1 schematically shows an axial section through a part of a centrifugal separator, which is provided with a device according to the invention, and each one of the FIG. 2 and FIG. 3 schematically shows a three dimensional view of an embodiment of an outlet element in a device according to the invention.

The centrifugal separator shown in FIG. 1 comprises a rotor, which has a lower part 1 and an upper part 2, which are joined together axially by means of a locking ring 3. Inside the centrifugal separator shown as an example there is arranged an axially movable valve slide 4. This valve slide 4 delimits together with the upper part 2 a separation chamber 5 and is arranged to open and close and annular gap towards the outlet openings 6 for a component, which during operation is separated out of a mixture supplied to the rotor and is collected at the periphery of the separation chamber 5. The valve slide 4 delimits together with the lower part 1 a closing chamber 7, which is provided with an inlet 8 and a throttled outlet 9 for closing liquid.

Inside the separation chamber 5 there is arranged a disk stack 10 consisting of a number of conical separation discs between a distributor 11 and the upper part 2. The upper part 2 forms at its upper end, shown in the figure, a chamber 12, to which in this case a specific lighter liquid component of the mixture can flow from the separation chamber 5 via an inlet 13. The liquid present in the chamber 12 during operation of the rotor forms a rotating liquid body having a radially inwards facing free liquid surface 14.

Centrally through the chamber 12 a stationary inlet tube 15 extends, which opens in the interior of the distributor 11. Around the inlet tube 15 there is arranged a stationary outlet tube 16 for the specific lighter liquid component in the chamber 12. In the chamber a discharge element 17 is arranged around the inlet tube 15 and connected to the outlet tube 16. The discharge element is stationary, but in an alternative outlet arrangement a similar discharge element can be arranged to rotate with a rotational speed which is lower than the rotational speed of the rotor.

The discharge element 17 extends radially outwards and has outside the radial level of the free liquid surface 14 of the rotational liquid body a part at least one inlet opening 18. This inlet opening 18 is connected to the interior of the outlet tube 16 via an outlet channel 19 formed in the discharge element 17.

In FIGS. 2 and 3 there is shown two examples of how a discharge element 17*a*, 17*b* in a centrifugal separator can be designed according to the present invention.

The discharge element 17*a* shown in FIG. 2 has a circular cylindrical surface 20, which during operation is located in the rotating liquid body in the chamber 12 and along which the liquid flows in a predetermined direction. Inside the discharge element 17*a* an outlet channel 19 extends, which has an inlet opening 22 in said surface and in its opposite end is connected to the interior of an outlet tube (not shown). In this example the inlet opening 22 seen in the flow direction of the liquid is limited by two straight side edges 23 and 24. Downstream and upstream ends of the inlet opening 22 is limited by cross edges 25 and 26 respectively.

At the connections between the cross edge 25 located downstream of the inlet opening and the two side edges 23 and 24 two passages 27 and 28 open into the outlet channel 19. These are symmetrically located on each side of a middle line to the inlet opening 22 extending in the flow direction of the liquid and connecting the outer channel to the surroundings of the discharge element 17*a*. From its connection to the outlet channel each one of the passages 27 and 28 extends essentially in the flow direction of the liquid. The passages 27 and 28 in this example are straight and have rectangular cross sections. The shown cross sections are open towards the surroundings of the discharge element 17*a* along the surface 20. However, the passages also can be designed with closed cross sections. In the shown example the outlet channel 19 is limited i.a. by two limiting surfaces 29 and 30, which at the surface 20 are connected to one of the cross edges 25 and 26 each.

In FIG. 3 there is shown another embodiment of the discharge element 17*b* in a device according to the invention. The discharge element in FIG. 3 differs from the one shown in FIG. 2 in that the side edges 31 and 32 diverge in the flow direction of the liquid and has a curved shape. The radius of the curvature of the side edges is then varied along the side edges seen in the flow direction of the liquid in a way such that the side edges are initially convex towards the inlet opening 33 and then turn to be concave towards the same. In the same manner as in FIG. 2 the two straight passages 34 and 35 open into the outlet channel 19.

In the shown embodiments the inlet openings are designed in a circular cylindrical surface and directed radially and the passages open in a surface facing axially towards the chamber 12. However, the invention is also applicable on discharge elements, the inlet openings of which are formed in surfaces which are directed in other directions, for instance axially.

We claim:

1. A discharge element for use in a centrifugal separator having a device for the transformation of kinetic energy of a liquid rotating in a chamber around a rotational axis to pressure energy, comprising: means defining a surface surrounding the rotational axis of the separator whereby the liquid in the chamber flows in a predetermined direction along and in contact with the surface; an outlet tube, the outlet tube being disposed at the center of the discharge element; outlet channel means for communicating between the surface means and the outlet tube, the outlet channel means including an inlet opening extending in the surface means substantially in the flow direction of the liquid flow, the inlet opening in the downstream direction of the liquid flow delimited by a cross edge extending perpendicular to the flow direction, the outlet channel extending for a distance in the downstream direction of the liquid flow from the cross edge; and two passages, each extending from one end of the cross edge, connecting a part of the outlet channel to the chamber and arranged so that liquid entering the outlet channel through the inlet opening is partially conducted to the chamber through the passages.

2. A discharge element as in claim 1, wherein the passages extend essentially in the predetermined direction of the flow along the surrounding surface.

3. A discharge element according to claim 2, wherein the passages extend in the direction of flow from the cross edge.

4. A discharge element as in claim 2, wherein the passages seen in the direction of flow extend toward the cross edge.

5. A discharge element as in claim 15, further comprising an even number of passages which are symmetrically located relative to the inlet opening.

6. A discharge element as in claim 5, wherein the inlet opening is delimited in the direction of flow by two side edges, each one of said side edges extends towards and turns into a delimiting surface of the passages.

7. A discharge element as in claim 6, wherein said side edges diverge with respect to one another in the direction of flow and have such a direction relative to the flow direction of the liquid in the rotating liquid body that liquid crossing a side edge flows towards the inlet opening.

8. A discharge element as in claim 6, wherein at least one of said side edges has a curved shape, the radius of the curvature of the side edge varies along the side edge length such that the curvature is concave towards the inlet opening at the end thereof located nearby the cross edge and concave towards the inlet opening at the opposite end thereof.

9. A discharge element as in claim 1, wherein the passages are straight and have rectangular cross sections.

10. A discharge element as in claim 1, wherein the passages have cross sections which are open towards said chambers.

11. A discharge element as in claim 1, wherein said surface means surrounding the rotational axis is facing radially.

12. A discharge element as in claim 11, wherein the passages open towards the chamber in the axially facing surface of the discharge element.

13. A discharge element as in claim 1, wherein said chamber is formed in a rotating casing.

14. A discharge element as in claim 2, wherein the passages are straight and have rectangular cross sections.

15. A discharge element as in claim 2, wherein the passages have cross sections which open towards the chamber.

16. A discharge element as in claim 2, wherein the surface surrounding the rotational axis is facing radially.

17. A discharge element as in claim 2, wherein the passages open towards the chamber in an axially facing surface of the discharge element.

18. In a centrifugal separator having a chamber for the rotation of liquid around a rotational axis therein, means for the transformation of kinetic energy of the liquid to pressure energy, said transformation means including a discharge element disposed within the chamber coaxially with the axis of rotation, said discharge element comprising:

means defining a surface surrounding the rotational axis, whereby the liquid in the chamber flows in a predetermined direction along and in contact with the surface;

means defining an interior of an outlet tube, the outlet tube being disposed at the center of the discharge element;

means defining an outlet channel for fluid communication between the surface of the centrifugal separator and the outlet tube, said outlet channel including an inlet opening in the surface extending substantially in the direction of flow, the inlet opening being limited in the downstream direction of the liquid flow by a cross edge extending perpendicular to the flow direction, the outlet channel extending for a distance in the predetermined direction from the cross edge; and at least two passages being defined in the discharge element, each passage extending from one end of the cross edge connecting a part of the outlet channel to the chamber and so arranged that liquid entering the outlet channel through the inlet opening is conducted to the chamber through the passages.

* * * * *